US006023678A

United States Patent [19]

Lewis et al.

[11] Patent Number: 6,023,678

[45] Date of Patent: Feb. 8, 2000

[54] USING TTS TO FILL IN FOR MISSING DICTATION AUDIO

[75] Inventors: James R. Lewis, Delray Beach; Kerry A. Ortega, Deerfield Beach, both of Fla.

[73] Assignee: International Business Machines Corporation, Armonk, N.Y.

[21] Appl. No.: 09/049,716

[22] Filed: Mar. 27, 1998

[51] Int. Cl.[7] ..... G01L 7/08

[52] U.S. Cl. ..... 704/260; 704/235; 704/272

[58] Field of Search ..... 704/270, 275, 704/272, 235, 260

[56] References Cited

U.S. PATENT DOCUMENTS

| | | | |
|---|---|---|---|
| 5,649,060 | 7/1997 | Ellozy et al. | 704/278 |
| 5,737,725 | 4/1998 | Case | 704/273 |
| 5,794,189 | 8/1998 | Gould | 704/231 |
| 5,799,273 | 8/1998 | Mitchell et al. | 704/235 |
| 5,857,099 | 1/1999 | Mitchell et al. | 704/235 |

OTHER PUBLICATIONS

Collegiate Microcomputer. Lees, "Proofreading with the ears," pp. 339–344, vol. 3, No. 4. Feb. 1994.

Language Toolkits for Engineers in Business. Fletcher, IBM Voice Type Software, 2 pages. Feb. 1997

Proceedings of the 1999 ACM ACM symposium on applied computing 1999. Ryder et al., "Multi–sensory Browser and Editor Model," pp. 443–449. 1999.

IBM Corporation. Lai et al., "MedSpeak:Report Creation with Continuous Speech Recognition," pp. 431–438. Mar. 1997.

*Primary Examiner*—Richemond Dorvil

*Attorney, Agent, or Firm*—Quarles & Brady LLP

[57] ABSTRACT

The invention provides a method for a speech application to read dictated text back to the user. As playback of dictated audio runs, the application searches ahead for words unassociated with the dictated audio. When the application encounters words unassociated with the dictated audio, the application sends the words to a Text-To-Speech engine to synthesize a spoken instance of each word. This method enhance the user's review of the effectiveness of the dictated text by providing an opportunity for the user to hear the entire document played back both the text that was dictated and the text that was typed.

1 Claim, 1 Drawing Sheet

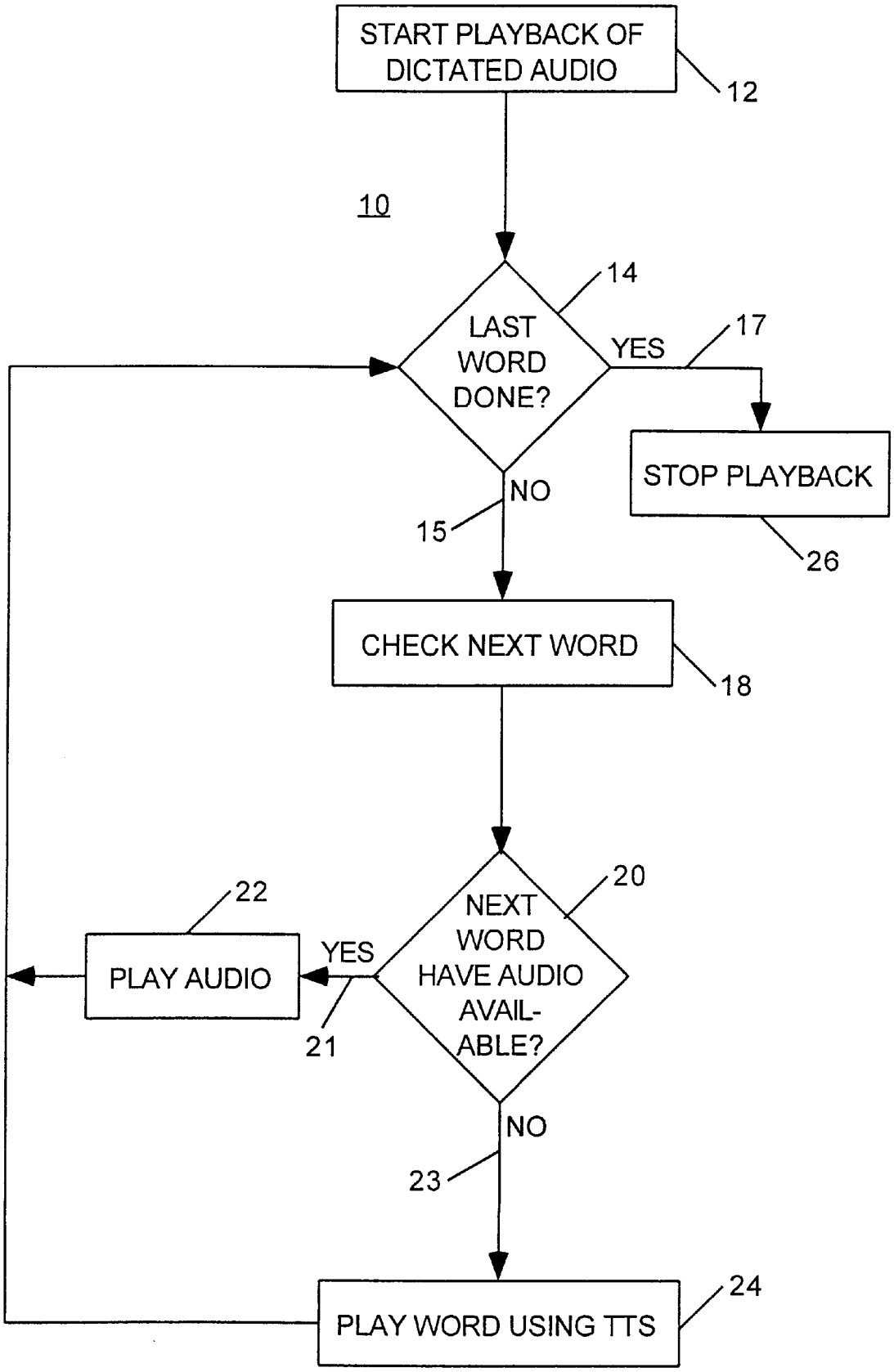
START PLAYBACK OF DICTATED AUDIO
12
10
14
LAST WORD DONE?
YES
17
STOP PLAYBACK
26
NO
15
CHECK NEXT WORD
18
20
NEXT WORD HAVE AUDIO AVAIL-ABLE?
22
PLAY AUDIO
YES
21
NO
23
PLAY WORD USING TTS
24

USING TTS TO FILL IN FOR MISSING DICTATION AUDIO

BACKGROUND OF THE INVENTION

1. Field of the Invention

This invention relates generally to the field of dictation with a speech application, and in particular, to a method for improving audio playback during proofreading.

2. Description of Related Art

An important technique for helping users proofread dictated text is to enable the users to play back the audio recorded during the dictation. However, there are sometimes gaps in which text is present but there is no corresponding user recorded audio to play back. Gaps in the dictated audio can result when the speech application loses track of the tags used to associate text and audio. Gaps in the dictated text can also result when the user typed in text into the otherwise dictated document, so that no audio was recorded in the first instance.

Existing speech dictation applications handle this situation differently. In MedSpeak®, available from IBM®, the application skips over the text for which no audio is available, and immediately resumes playback as soon as audio is available. In VoiceType® Dictation, also available from IBM®, none of the text will be played back.

There is a clear need to provide users with some manner of audio playback for all of the text when proofreading.

SUMMARY OF THE INVENTION

In accordance with the inventive arrangements, text-to-speech (TTS) is used to fill in the audio gaps. As playback of the dictated audio runs, the application searches several words ahead to detect any non-audio speech, that is, text for which no audio can be found irrespective of the reason. When the application encounters the non-audio text, the application sends the text as required to the TTS engine associated with the speech application of production of the missing audio. As soon as the user audio is again available, normal playback resumes.

A method for playing back dictated audio, in accordance with the inventive arrangements, comprises the steps of: playing back as a stream of audible words each word in a sequence of dictated text recognized by a speech application by using dictated audio; as the playing back continues, searching ahead in the sequence for words unassociated with dictated audio; processing each the word unassociated with dictated audio in a text to speech engine to synthesize a spoken instance of each the word unassociated with dictated audio; and, inserting the synthesized spoken words into the stream of audible words to fill in for each of the words unassociated with dictated audio, whereby the stream of audible words is a complete playback of the dictated text sequence.

BRIEF DESCRIPTION OF THE DRAWINGS

The sole FIGURE is a flow chart useful for explaining how TTS can be used to fill in for missing audio during proofreading of dictated text.

DETAILED DESCRIPTION OF THE PREFERRED EMBODIMENTS

A method 10 for using TTS to fill in for missing dictation audio during audio playback while proofreading dictated text is illustrated by the flow chart in the sole FIGURE. Playback of dictated audio is started in accordance with the step of block 12. In accordance with the step of decision block 14, the method asks whether or not the last dictated word has been played back. If not, the method branches on path 15 to the step of block 18, in accordance with which the next word of text is checked for an associated audio segment. This checking is done by looking for the tags which associate text with audio. This checking is also done several words ahead, so that there is sufficient time for the filled in word to be produced by the TTS engine and inserted substantially seamlessly into the played back audio.

The step of decision block 20 asks whether or not the next checked word has dictated audio available. If dictated audio is available, the method branches on path 21 to the step of block 22, in accordance with which the available audio is played back. Thereafter, the method returns to decision block 14. If dictated audio is not available, the method branches on path 23 to the step of block 24, in accordance with which the word is played back using the TTS engine. Thereafter, the method returns to decision block 14.

In accordance with decision block 14, the playback continues, with substitution of TTS generated audio when necessary until the last word is done. When the last word is done, the method branches on path 17 to the step of block 26, in accordance with which the audio playback is stopped.

The inventive arrangements provide a way for a speech application to read dictated text back to the user, utilizing the user's own voice as much as possible, but filling in with TTS generated audio as necessary. This technique provides two very important and unique advantages in exploiting the capabilities of a speech application. The first advantage is to enhance proofreading because the application seamlessly handles non-audio text. The second advantage is to enhance the user's review of the effectiveness of the dictated text by providing an opportunity for the user to hear the entire document played back, both the text that was dictated and the text that was typed.

What is claimed is:

1. A method for playing back dictated audio, comprising the steps of:

playing back as a stream of audible words each word in a sequence of dictated text recognized by a speech application by using dictated audio;

as said playing back continues, searching ahead in said sequence for words unassociated with dictated audio;

processing each said word unassociated with dictated audio in a text to speech engine to synthesize a spoken instance of each said word unassociated with dictated audio; and, inserting said synthesized spoken words into said stream of audible words to fill in for each of said words unassociated with dictated audio, whereby said stream of audible words is a complete playback of said dictated text sequence.

* * * * *